US006350055B1

(12) United States Patent
Barras

(10) Patent No.: US 6,350,055 B1
(45) Date of Patent: Feb. 26, 2002

(54) WRISTWATCH WITH CAPACITIVE COUPLING

(75) Inventor: David Barras, Grenchen (CH)

(73) Assignee: Eta Sa Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/468,344

(22) Filed: Dec. 21, 1999

(30) Foreign Application Priority Data

Dec. 22, 1998 (CH) ..... 2534/98

(51) Int. Cl.[7] ..... G04B 37/00; A44C 5/00
(52) U.S. Cl. ..... 368/281; 368/276; 368/282
(58) Field of Search ..... 368/10, 276, 281, 368/282, 221, 203–204

(56) References Cited

U.S. PATENT DOCUMENTS 3,973,706 A * 8/1976 Boyce et al. ..... 368/204
4,323,996 A * 4/1982 Ganter ..... 368/203
4,690,567 A * 9/1987 Rebeaud ..... 368/282
5,144,599 A * 9/1992 Blaich et al. ..... 368/10
5,159,713 A 10/1992 Gaskill et al.
5,170,173 A 12/1992 Krenz et al.
5,526,006 A * 6/1996 Akahane et al. ..... 368/282
5,889,737 A * 3/1999 Alameh et al. ..... 368/281
5,917,429 A * 6/1999 Otis, Jr. et al. ..... 368/10
6,181,287 B1 * 1/2000 Beigel ..... 343/741
6,158,884 A * 12/2000 Lebby et al. ..... 368/282

FOREIGN PATENT DOCUMENTS

GB 2 137 783 10/1984
GB 2 201 266 8/1988

* cited by examiner

*Primary Examiner*—Diego Gutierrez
*Assistant Examiner*—Jeanne-Marguerite Goodwin
(74) *Attorney, Agent, or Firm*—Sughrue Mion, PLLC

(57) ABSTRACT

The present invention concerns a wristwatch (30) including a case (32) provided with a first electric conductor (50) and an electric circuit (36) connected to said first electric conductor, and a wristband (34) including a second electric conductor (42). This wristwatch is characterised in that the first and second conductors are arranged to form an electric connection without any mechanical contact and, more precisely, by capacitive coupling. One advantage of such an arrangement of the wristwatch is that it achieves an electric connection without mechanical coupling, i.e. an electric connection which does not require any additional external material arrangement other than the conventional articulation between the wristband and the case.

8 Claims, 2 Drawing Sheets

WRISTWATCH WITH CAPACITIVE COUPLING

BACKGROUND OF THE INVENTION

The present invention concerns the technical field of wristwatches and, more particularly, that of wristwatches including a case provided with a first electric conductor, and an electric circuit connected to the first electric conductor, and a wristband including a second electric conductor.

With reference to FIG. 1 of the present description, European Patent No. 0 186 804 discloses a wristwatch 1 including a case 3 and a wristband 5 associated with said case. Case 3 includes an electric circuit 7 provided with an integrated circuit (not shown in FIG. 1) and a display device 9, case 3 being sealed by a crystal 11. Wristband 5 includes two strips 12*a* and 12*b* formed of a flexible plastic material, and a conductor 24*a* arranged between these two strips. Strip 12*a* includes a thick zone 26, of bulged shape in which is arranged a transverse opening 27 intended to accommodate a pin 28 by means of which wristband 5 is hinged to case 3.

One problem encountered with wristwatch 1 lies in forming an electric connection between electric circuit 7 of case 3 and conductor 24*a* of wristband 5.

The solution according to European Patent No. 0 186 804 consists in forming an electric connection via mechanical contact between electric circuit 7 and conductor 24*a*. Thus, wristwatch 1 includes a junction device 13 including a set of contact elements 15 formed by a rigid conductive element 17, an elastic conductive element 19, and a cylindrical slug 21, these components being arranged to form the electric connection between conductor 24*a* and integrated circuit 7.

However, an electric connection of this type has several drawbacks. An alteration in this electric connection can occur due to sealing problems (in particular oxidation of the junction device components) and during maintenance of the wristwatch (in particular during replacement of the wristband by a new wristband).

Another drawback of wristwatch 1 lies in the fact that the rotation of wristband 5 about pin 28 of case 3 is limited, because of the presence of junction device 13 which is fixed with respect to the case, which limits the comfort of the wearer of wristwatch 1.

Another drawback of wristwatch 1 lies in the fact that the choice of materials used to form case 3 is limited to achieve electric insulation of the electric connection between integrated circuit 7 and conductor 24*a*.

U.S. Pat. No. 5,159,713 discloses a wristwatch with a communication device for transmitting and receiving messages, such as a pager. FIGS. 12*a* to 12*c* of this document show that the watch wristband includes a metal strip extended over the entire length of the wristband and forming an antenna for the message transmitting and receiving device.

The ends of the metal strip are each connected in electric and mechanical contact to a metal pin hinging the wristband to the watch case.

The metal ends of the pin each rest in a metal articulation housing of the watch case forming an electric connection between the wristband antenna and the electronic circuit housed in the case.

Drawbacks of this design lie on the one hand in the fact that the mechanical contact between the pin and its housing also has to assure the electric connection between the antenna and the electronic circuit, and on the other hand as regards the articulation pin, when the wristband is changed.

The contact metal parts of the pin and its housing can oxidise in a damp atmosphere or suffer damage capable of modifying the electric contact resistance which can affect the impedance value from the antenna to the electronic circuit.

Instead of assuring the electric connection in a resistive manner via mechanical contact between two contact pads, one can envisage assuring said connection using a capacitive coupling which avoids the aforecited drawbacks.

One example of such a connection by capacitive coupling is disclosed in U.S. Pat. No. 5,170,173 which concerns the field of communication devices, such as wireless portable telephones. The hinge between the portion of the microphone and the main body is provided with two coupling capacitors to electrically connect each end of the antenna arranged in the microphone portion. Two embodiments are described wherein the coupling capacitors are either capacitors with a plane circular plate arranged perpendicular to the articulation pin with a dielectric between the plates, or tubular capacitors arranged radially along the articulation pin with a dielectric between the metal tubes.

It is to be noted that, whatever the position of the microphone portion with respect to the main body, the capacitances do not change value.

Hinges of this type for mobile telephones are of significant dimensions which does not pose a problem for housing capacitors in the form of circular or tubular plates therein. Moreover, the telephone case is made of plastic material which makes it easy to inlay connection wires to the plates or tubes of the coupling capacitors, for example by moulding. However, providing such an arrangement in the case of a metal case is not envisaged, since the shape of the capacitors would have to change significantly.

An arrangement of this type in a wristwatch can cause certain drawbacks, as indicated above, when the articulation pin is used as means for providing an electric connection with an electronic circuit in the case. Moreover, in the watchmaking industry, space requirement and rationalisation are important parameters for an arrangement of this type as a function particularly of production costs and the facility with which a watch wristband can be changed.

SUMMARY OF THE INVENTION

An object of the present invention is to provide a wristwatch including a case provided with a first electric conductor arranged in the vicinity of a first outer surface of the case and an electric circuit connected to the first electric conductor, and a wristband including a second electric conductor arranged in the vicinity of a second outer surface of the wristband, said first and second conductors being arranged to establish an electric connection by capacitive coupling while overcoming the aforementioned drawbacks.

Another object of the present invention is to provide a wristwatch of this type arranged to prevent any alteration in the electric connection between the first and second electric conductors.

Another object of the present invention is to provide a wristwatch of this type wherein the arrangement of the electric connection makes replacing the wristband easy.

Another object of the present invention is to provide a wristwatch of this type wherein the arrangement of the electric connection does not limit the movement of the wristband with respect to the case, in order to improve the comfort of the wristwatch wearer.

Another object of the present invention is to provide a wristwatch of this type wherein the arrangement of the electric connection does not limit the choice of materials used to form the case.

Another object of the present invention is to provide a wristwatch answering the usual concerns as to space requirement and rationality in a horological application.

Another object of the present invention is to provide a wristwatch answering the usual concern in the industry, as to the cost.

These objects, in addition to others, are achieved by the wristwatch according to claim 1.

One advantage of the arrangement of the first and second conductors of such a wristwatch is that an electric connection without any mechanical contact is made and, more precisely, by a capacitive coupling between the first conductor of the case and the second conductor of the wristband, which does not require any additional external material arrangement other than the conventional articulation between the wristband and the case.

Another advantage of such an arrangement of the first and second conductors is that it avoids limiting the movement of the wristband with respect to the case, as is the case in conventional wristwatches, because of the presence of a mechanical or galvanic contact between the first conductor of the case and the second conductor of the wristband.

Another advantage of such an arrangement of the first and second conductors is that it facilitates replacement of the wristband by another similar wristband, without there being any material deterioration in the electric connection between the first conductor of the case and the second conductor of the wristband, following such replacement.

BRIEF DESCRIPTION OF THE DRAWINGS

These objects, features and advantages of the present invention, in addition to others, will appear more clearly upon reading the detailed description of two preferred embodiments of the invention, given solely by way of example, with reference to the annexed drawings in which.

DETAILED DESCRIPTION OF THE INVENTION

Figure 1:
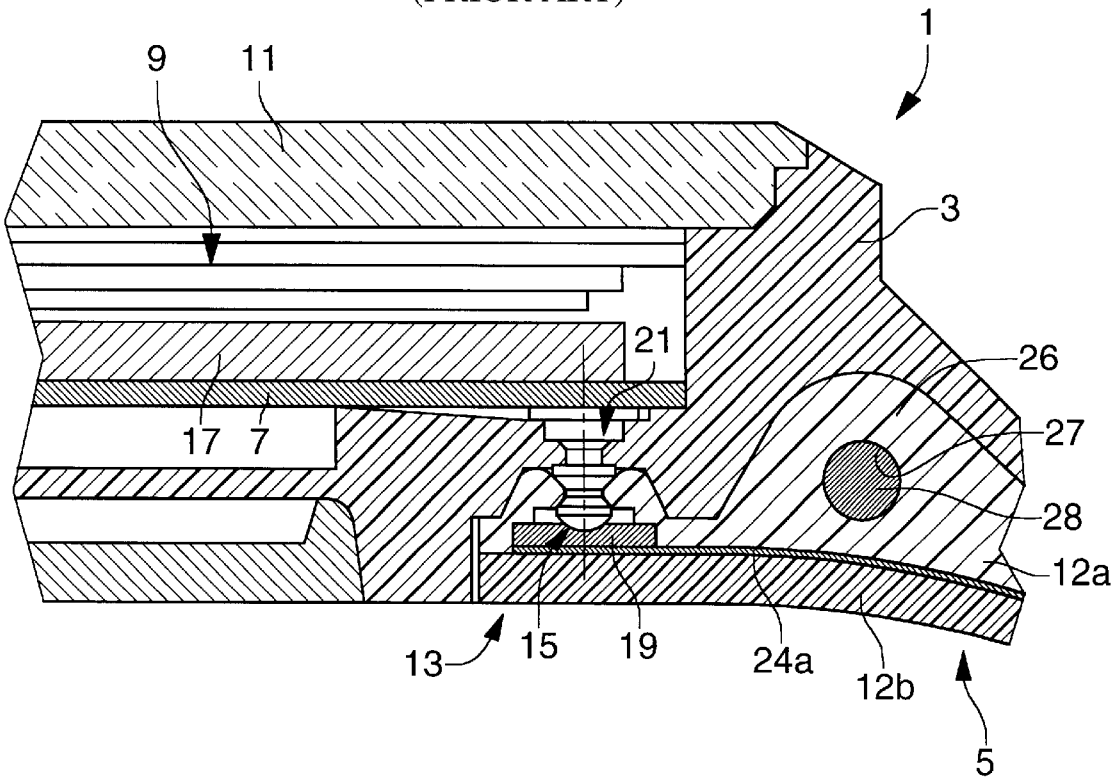
Fig. 1 (PRIOR ART)
FIG. 1 cited above shows a partial cross-section of a conventional wristwatch.
Figure 2:
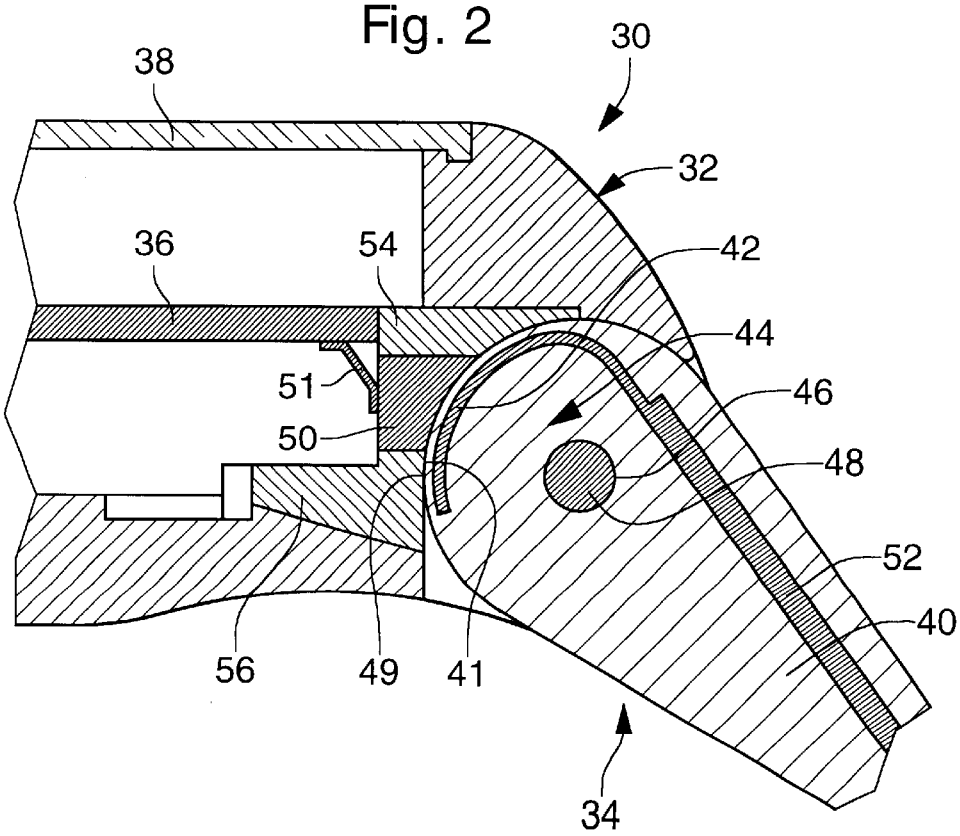
FIG. 2 shows a partial cross-section of a wristwatch according to the present invention.

With reference to FIG. 2, wristwatch 30 includes a case 32 and a wristband 34 associated with said case. Case 32 includes an electric circuit 36 provided with an integrated circuit (not shown in FIG. 1), case 32 being sealed by a crystal 38. Wristband 34 includes a strip 40 formed of a flexible plastic material. Strip 40 includes a thick zone 44 having an outer surface 41 of rounded shape in which is arranged a transverse opening 46 able to accommodate a pin 48 by means of which wristband 34 is hinged to case 32. Wristband 34 also includes an electric conductor, or second conductor 42, incorporated in strip 40, in the outer portion of its rounded shape.

Case 32 further includes an outer surface 49 and an electric conductor, or first conductor 50, connected to electric circuit 36, and arranged in the vicinity of outer surface 49.

Outer surface 49 of case 32 is arranged opposite outer surface 41 of wristband 34 so that conductors 42 and 50 form the two electrodes of a coupling capacitor, which forms a capacitive coupling between wristband 34 and case 32. It follows from this arrangement that an electric connection is achieved without mechanical contact and, more precisely, by capacitive coupling between conductor 42 and electric circuit 36.

Typically, each of conductors 42 and 50 is preferably made by forming a metal layer having a surface area equal to several square millimeters, and covered with an electrically insulating material.

One advantage of the arrangement of such an insulating material on conductors 42 and 50 is that it prevents these conductors oxidising.

Another advantage of the arrangement of such an insulating material on conductors 42 and 50 is that it improves the sealing or water resistance of wristwatch 30.

In the example shown in FIG. 2, wristwatch 30 further includes a conductor 51 arranged to form an electric connection between conductor 50 and electric circuit 36.

By way of example, wristband 34 can also include an antenna 52 one of whose electrodes is formed by conductor 42, as is shown in FIG. 2.

One advantage of this arrangement of antenna 52 in wristband 34 is that antenna 52 is connected to electronic circuit 36 without a galvanic electric connection being formed between these two components.

Another advantage of this arrangement of antenna 52 in wristband 34 is that the space requirement of case 32 is reduced.

Figure 3:
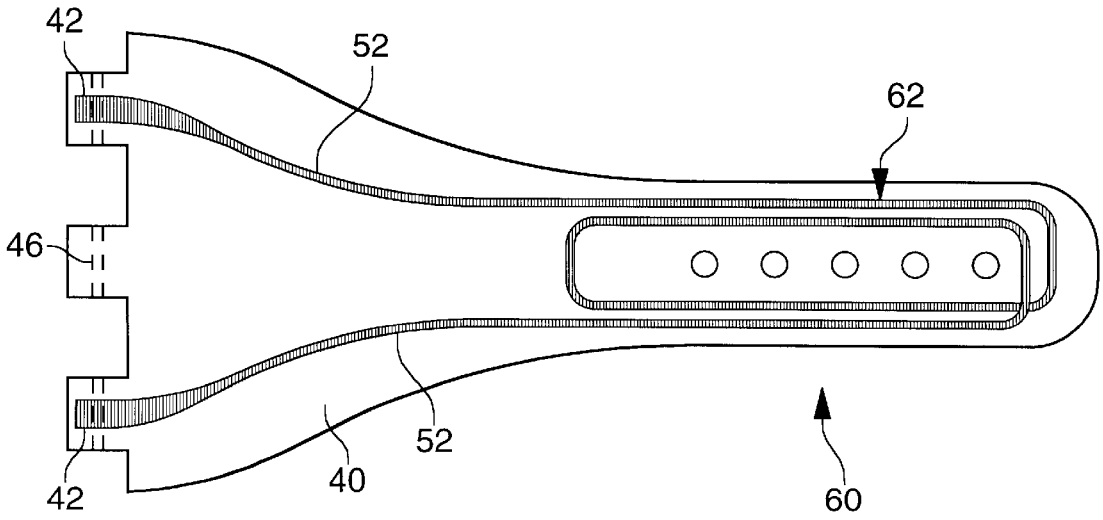
FIG. 3 shows an alternative embodiment of the wristband of the wristwatch of FIG. 2.

As an alternate embodiment, FIG. 3 shows a partial view of a wristband 60 of a wristwatch according to the present invention. It is to be noted that the case (not shown) of this watch is similar to case 32 of FIG. 2. It is also to be noted that the elements of FIG. 3 which are similar to those described in relation to FIG. 2 have been designated by the same references. As FIG. 3 shows, wristband 60 includes a coil 62 provided with two conductors 52 arranged to form two respective couplings similar to that described in relation to FIG. 2, which forms two electric connections between the case and wristband 60.

With reference once more to FIG. 2, and in the particular case in which case 32 is formed of a metallic material, case 32 can include two zones 54 and 56 formed of an electrically insulating material, and arranged on either side of conductor 50, so as to form the electric insulation between conductor 50 and the metal case of wristwatch 30. Zones 54 and 56 can be made by forming a single annular part arranged around conductor 50.

One advantage of this arrangement of insulating zones 54 and 56 is that it achieves electric insulation of the electric circuit made in wristwatch 30, as regards external disturbances of an electrical and magnetic nature.

Another advantage of this arrangement of insulating zones 54 and 56 is that it avoids the formation of a parasitic coupling, in particular in the event that case 32 is arranged to form the earth of electric circuit 36.

By way of improvement, conductor 42 is arranged in wristband 34, to have a rounded shape matching or suited to the rounded shape of wristband 34, so that, once wristband 34 is mounted onto case 32, the same distance is present between conductors 42 and 50, whatever the position of wristband 34 with respect to case 32.

One advantage of this arrangement of conductors 42 and 50 (in particular of the equal distance between these two conductors) is that it assures a constant capacitance value of the coupling capacitor formed by these conductors, whatever the position of wristband 34 with respect to case 32.

Another advantage of this arrangement of conductors 42 and 50 is that it facilitates the fitting of wristwatch 30 to different wrist sizes, without there having any influence on the electric connection between electric circuit 36 and conductor 42.

It goes without saying for those skilled in the art that the detailed description hereinbefore can undergo various modifications without departing from the scope of the present invention. By way of example, a capacitive coupling can be made between the wristband and the case, at each of the two articulations of the wristband to the case.

What is claimed is:

1. A wristwatch including:

a case provided with at least a first electric conductor arranged in the vicinity of an outer surface of the case and an electric circuit connected to said first electric conductor, a wristband including at least a second electric conductor arranged in the vicinity of an outer surface of the wristband, portions of said first and second conductors being at a distance from and opposite to each other to define two electrodes of a coupling capacitor and to form an electric connection by capacitive coupling, wherein said second electric conductor is arranged to have a shape suited to said outer surface of the wristband opposite to said first electric conductor, and wherein the distances between said electrodes of the coupling capacitor and opposite surfaces of each electrode are the same once said wristband is mounted onto said case in order to assure a constant capacitance value of the coupling capacitor, whatever the angular position of said wristband with respect to said case.

2. A wristwatch according to claim 1, wherein said wristband incorporates an antenna having ends which are formed by said second electric conductor and another second electric conductor, so that, once said wristband is mounted onto said case, said antenna is electrically connected to said first electric conductor and another first electric conductor, respectively, via said capacitive coupling.

3. A wristwatch according to claim 1, further including an electric circuit connected to said first electric conductor, so that, once said wristband is mounted onto said case, said electric circuit being electrically connected to said second electric conductor, via said capacitive coupling.

4. A wristwatch according to claim 1, wherein the second electric conductor is covered with an electrically insulating material, and wherein the surface of the first electric conductor opposite the second conductor is level with the first outer surface.

5. A wristwatch according to claim 1, wherein each of said first and second electric conductors is formed of a metal layer covered with an electrically insulating material.

6. A wristwatch according to claim 1, wherein said case is formed of a metallic material, and wherein said case includes first and second zones formed in an electrically insulating material, and arranged on either side of said first electric conductor, so as to achieve electric insulation between the case and the first electric conductor of said wristwatch.

7. A wristwatch according to claim 1, wherein said case is formed of a metallic material, and wherein said case includes at least one zone of insulating material embedding said first electric conductor, so as to achieve electric insulation between the case and the first electric conductor of said wristwatch.

8. A wristwatch according to claim 1, wherein the second electric conductor in the vicinity of the outer surface of the wristband opposite to said first electric conductor has the shape of a circular sector centered with respect to an axis of rotation of the wristband and the case of the watch.

* * * * *